US008256247B2

(12) United States Patent
Ha

(10) Patent No.: US 8,256,247 B2
(45) Date of Patent: Sep. 4, 2012

(54) WASHING MACHINE AND MANUFACTURING METHOD THEREOF

(75) Inventor: Deok Hwan Ha, Bupyeong-gu (KR)

(73) Assignee: Daewoo Electronics Corporation, Seoul (KR)

( * ) Notice: Subject to any disclaimer, the term of this patent is extended or adjusted under 35 U.S.C. 154(b) by 552 days.

(21) Appl. No.: 12/265,028

(22) Filed: Nov. 5, 2008

(65) Prior Publication Data

US 2009/0113942 A1 May 7, 2009

(30) Foreign Application Priority Data

Nov. 5, 2007 (KR) ..... 10-2007-0112001
Nov. 5, 2007 (KR) ..... 10-2007-0112002

(51) Int. Cl.
*D06F 21/00* (2006.01)
*D06F 23/00* (2006.01)
*D06F 25/00* (2006.01)

(52) U.S. Cl. ..... 68/140

(58) Field of Classification Search ..... 68/140
See application file for complete search history.

(56) References Cited

U.S. PATENT DOCUMENTS

2004/0103695 A1* 6/2004 Lim ..... 68/12.16
2006/0196233 A1* 9/2006 Kim et al. ..... 68/140
2007/0138902 A1* 6/2007 Ahn et al. ..... 310/261
2009/0100879 A1* 4/2009 Kim et al. ..... 68/140

* cited by examiner

*Primary Examiner* — Michael Barr
*Assistant Examiner* — Charles W Kling
(74) *Attorney, Agent, or Firm* — Occhiuti Rohlicek & Tsao LLP

(57) ABSTRACT

A washing machine and a method for manufacturing the same are disclosed. The washing machine includes a tub, a bearing housing having a fastening member and formed by insert-injection molding into the tub so as to expose the fastening member from the tub, and a stator mounted to the fastening member. The washing machine can maintain concentricity of the stator and permit simplification of an assembly process to reduce manufacturing costs.

5 Claims, 8 Drawing Sheets

WASHING MACHINE AND MANUFACTURING METHOD THEREOF

CROSS-REFERENCE TO RELATED APPLICATIONS

This application claims priority to Korean Application No. 10-2007-0112001 filed on Nov. 5, 2007 and Korean Application No. 10-2007-0112002 filed on Nov. 5, 2007. The contents of which are hereby incorporated by reference in its entirety.

BACKGROUND OF THE INVENTION

1. Field of the Invention

The present invention relates to a washing machine and, more particularly, to a washing machine and manufacturing method thereof capable of simplifying an assembly process and maintaining concentricity of a stator.

2. Description of the Related Art

Generally, a washing machine is designed to wash laundry using a suitable detergent and mechanical force. Particularly, a drum type washing machine is designed to receive the laundry in a horizontally disposed drum which is rotated by a drive force from a motor, and to wash the laundry by impact generated between the laundry and the drum when the laundry is lifted and dropped inside the rotating drum. The drum type washing machine has many advantages, such as effective washing, minimal damage to and less entanglement of laundry, etc.

FIG. 1 is a section side elevation of a conventional drum type washing machine.

Referring to FIG. 1, a conventional drive unit of the drum type washing machine includes a stator 1 which has a coil wound around a laminated iron core stack to generate a rotational magnetic field when electric current flows through the coil, and a rotor 5 rotated by the rotating magnetic field from the stator 1 to rotate a drive shaft 3.

The drive shaft 3 is provided at one side thereof with a bearing housing 7 that has a bearing 7*a* received therein to rotatably support the drive shaft 3, and the stator 1 is provided at one side of the bearing housing 7.

The drive shaft 3 is secured to a drum 13 to allow the drum 13 to rotate along with the drive shaft 3, and a tub 15 is provided outside the drum 13 to accommodate wash water.

In recent years, the drum type washing machine has been increased in capacity. Thus, in the structure of the conventional drum type washing machine wherein the stator is installed to have a radial direction facing the ground, use of a stator having a weight of 1.5 kg or more and fastened to the tub causes many problems such as damage of the tub and the like.

To solve such problems, a metallic supporter can be provided between a rear wall of the tub and the stator. In this case, however, separate processes of coupling the bearing housing and the supporter to the rear wall of the tub are needed, thus complicating an assembly process, which in turn deteriorates productivity. Further, since this structure requires an increased number of assembling steps, there is a problem in that assembly errors can occur due to such an increased number of assembling steps, thus causing deviation of concentricity of the bearing housing and the stator. Therefore, there is a need for solving such problems of the conventional techniques.

SUMMARY OF THE INVENTION

The present invention is conceived to solve the problems of the conventional techniques as described above, and an aspect of the present invention is to provide a washing machine and manufacturing method thereof capable of maintaining concentricity of a stator and simplifying an assembly process to reduce manufacturing costs.

In accordance with an aspect of the present invention, a washing machine includes: a tub; a bearing housing having a fastening member and formed by insert-injection molding into the tub so as to expose the fastening member from the tub; and a stator mounted to the fastening member.

The fastening member may be formed integrally with the bearing housing.

The fastening member may be provided as a separate component to be fastened to the bearing housing.

The bearing housing may include a bearing support having a stepped surface on an inner circumference of the bearing support to support a bearing; a fastening part extending radially from the bearing support and provided with the fastening member; and a flange part extending radially from the fastening part.

The washing machine may further include a nut member coupled to the fastening member to force the stator to come into close contact with a rear wall of the tub.

The fastening member may include a fastening hole having a thread on an inner circumference of the fastening hole, and the washing machine may further include a bolt member coupled to the fastening hole to force the stator to come into close contact with a rear wall of the tub.

In accordance with another aspect of the present invention, a washing machine includes: a tub; a bearing housing having a fastening member and formed by insert-injection molding into the tub so as to expose the fastening member from the tub; a stator mounted to the fastening member; and a supporter mounted to the fastening member to support the stator.

The fastening member may be formed integrally with the bearing housing.

The fastening member may be provided as a separate component to be fastened to the bearing housing.

The washing machine may further include a nut member coupled to the fastening member to force the stator to come into close contact with a rear wall of the tub.

In accordance with a further aspect of the present invention, a method for manufacturing a washing machine includes: forming a bearing housing having a fastening member; insert-injection molding the bearing housing into a tub so as to expose the fastening member from the tub; and mounting a stator to the fastening member.

The method may further include coupling a nut member to the fastening member to force the stator to come into close contact with a rear wall of the tub.

In accordance with yet another aspect of the present invention, a method for manufacturing a washing machine includes: forming a bearing housing having a fastening member; insert-injection molding the bearing housing into a tub so as to expose the fastening member from the tub; mounting a stator to the fastening member; and mounting a supporter to the fastening member to support the stator.

The method may further include coupling a nut member to the fastening member to force the stator to come into close contact with a rear wall of the tub.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION OF THE INVENTION

Exemplary embodiments of the present invention will be described in detail with reference to the accompanying drawings hereinafter. For convenience of description, a drum type washing machine will be described by way of illustration. Here, it should be noted that the drawings are not to precise scale and may be exaggerated in thickness of lines or size of components for descriptive convenience and clarity.

Furthermore, terms used herein are defined by taking functions of the present invention into account and can be changed according to the custom or intention of users or operators. Therefore, definition of the terms should be made according to overall disclosures set forth herein.

Figure 1:
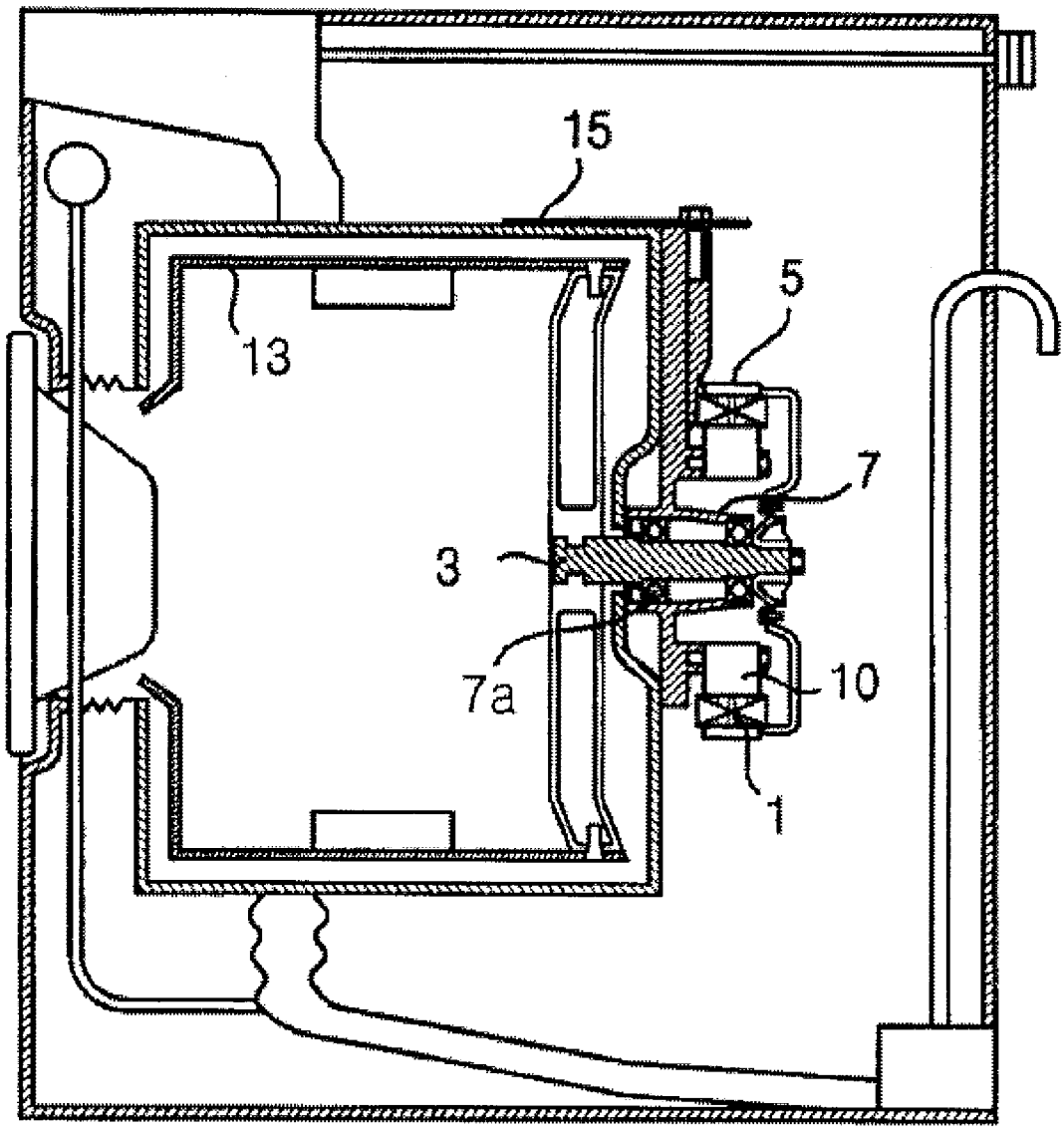
FIG. 1 Prior Art
FIG. 1 is a section side elevation of a conventional drum type washing machine.
Figure 2:
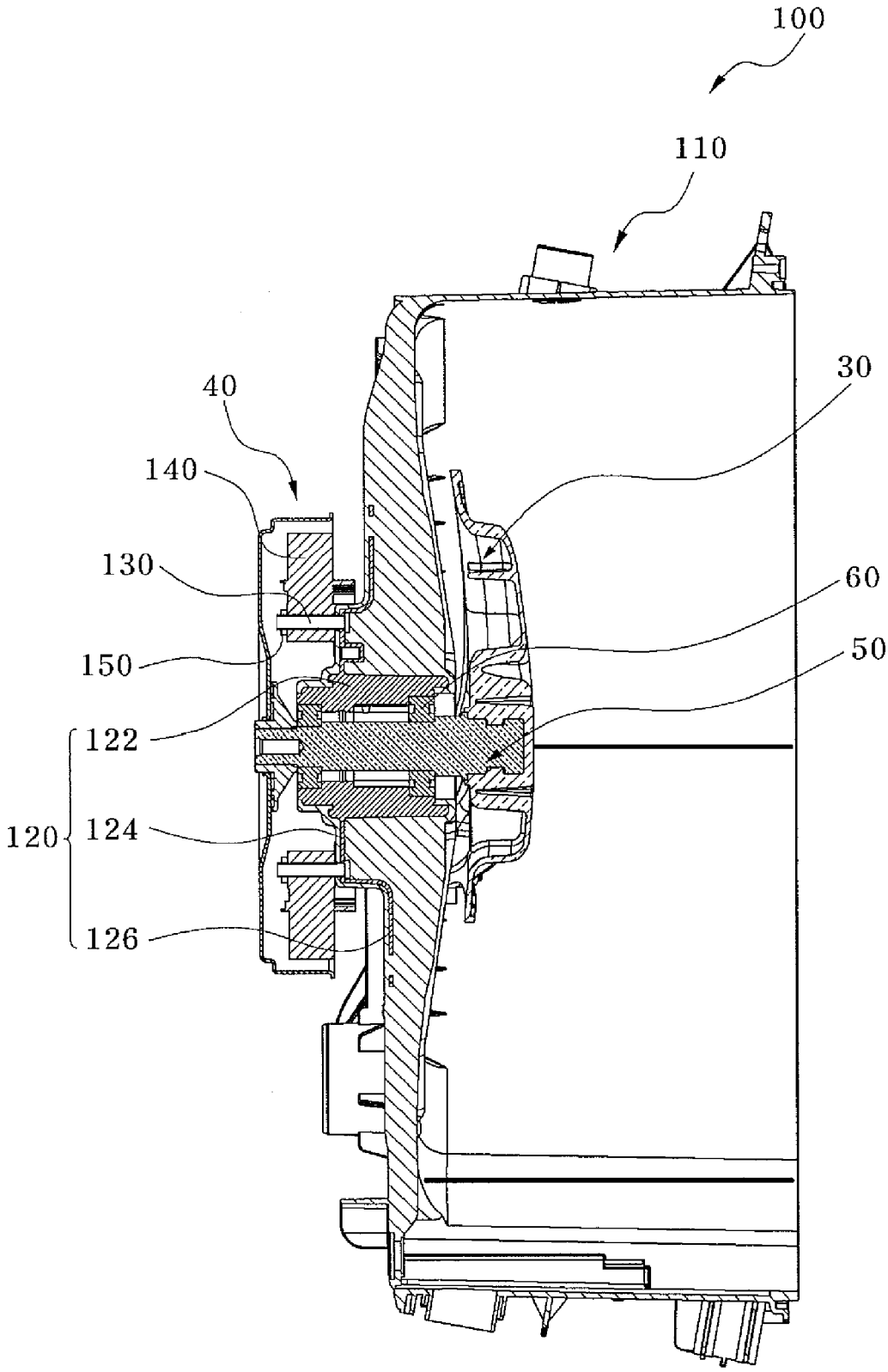
FIG. 2 is a section side elevation of a washing machine according to a first embodiment of the present invention.
Figure 3:
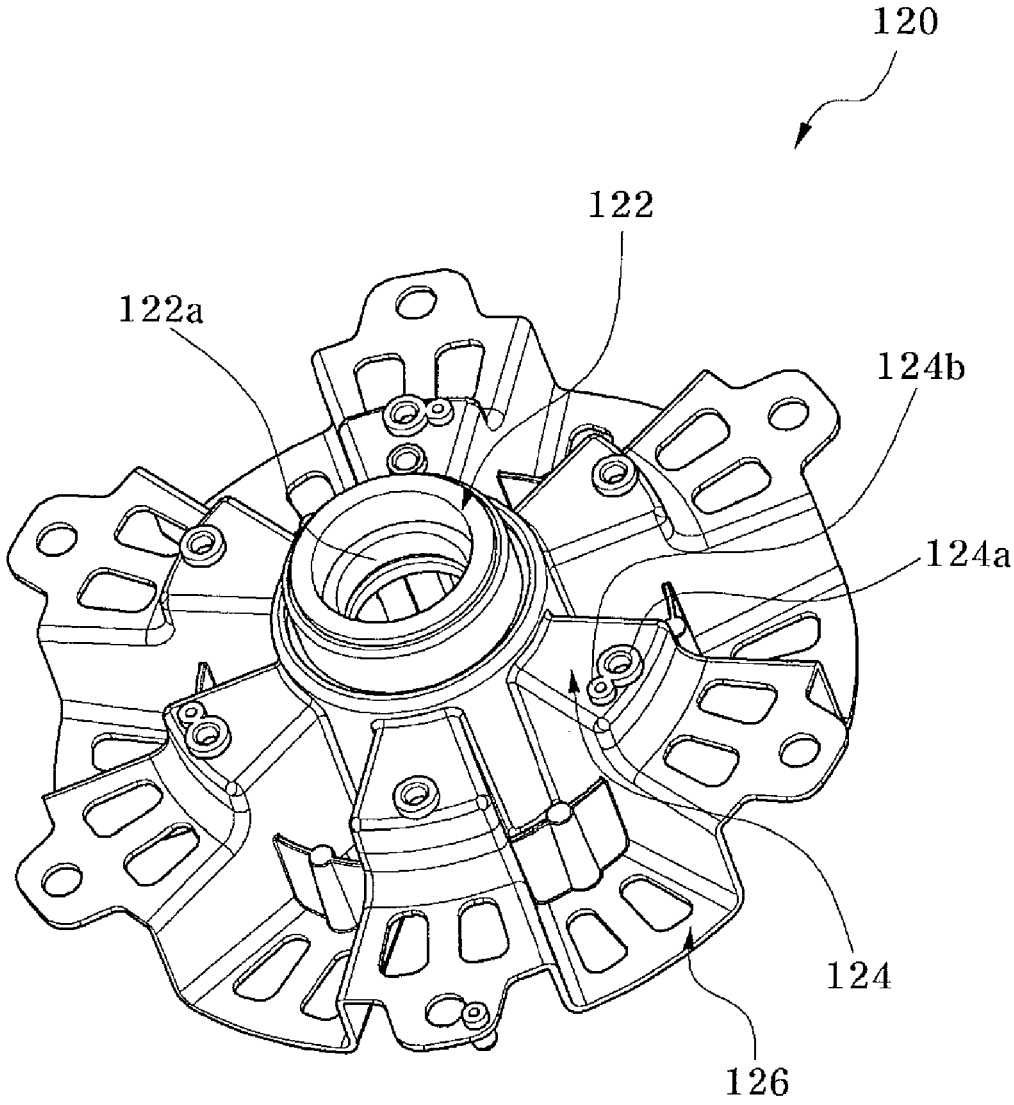
FIG. 3 is a perspective view of a bearing housing shown in FIG. 2.
Figure 4:
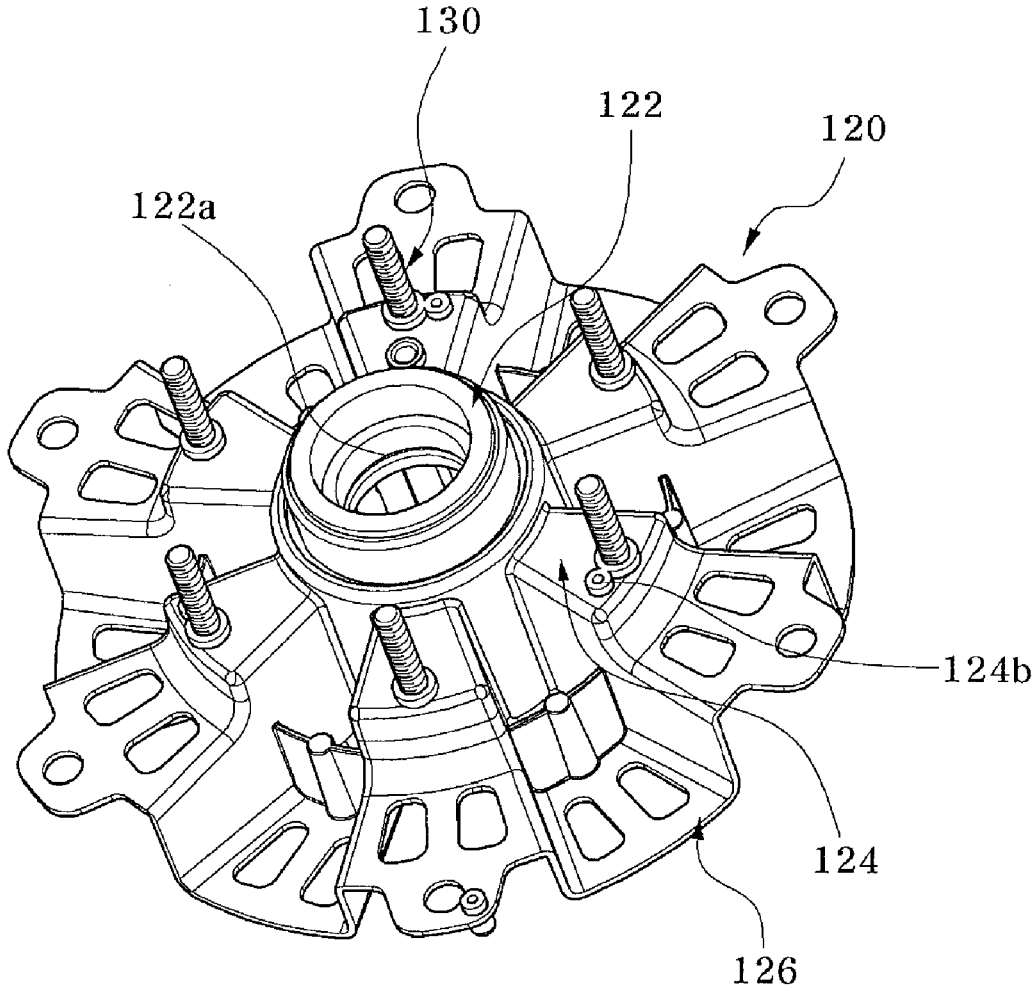
FIG. 4 is a perspective view of the bearing housing and a fastening member shown in FIG. 2.

FIG. 2 is a section side elevation of a washing machine according to a first embodiment of the present invention, FIG. 3 is a perspective view of a bearing housing shown in FIG. 2, and FIG. 4 is a perspective view of the bearing housing and a fastening member shown in FIG. 2.

Referring to FIGS. 2 to 4, the washing machine 100 according to the first embodiment of the present invention includes a tub 110, a bearing housing 120, a fastening member 130, and a stator 140.

The tub 110 is disposed inside a cabinet (not shown) of the washing machine. The tub 110 is an injection molded product and can be formed of plastics or synthetic resins. The washing machine has a drum 30 rotatably disposed inside the tub 110. A shaft 50 is connected with the drum 30 through the center of a rear wall of the tub 110 to transmit a drive force from a motor 40 to the drum 30.

The bearing housing 120 supports a bearing 60 that is disposed at either end of the shaft 50.

The bearing housing 120 is provided with a fastening member 130. The fastening member 130 may be formed integrally with the bearing housing 120. Alternatively, the fastening member 130 may be provided as a separate member to be mounted to the bearing housing 120.

The bearing housing 120 having the fastening member 130 is provided to the tub 110 via insert injection molding. The bearing housing 120 includes a bearing support 122, a fastening part 124, and a flange part 126.

The bearing support 122 is formed in a sleeve shape at the center of the bearing housing 120, and has a stepped surface 122*a* formed on an inner circumference of the bearing support 122 to support the bearing 60.

The fastening part 124 extends radially from the bearing support 122. The fastening part 124 serves to receive the fastening member 130 integrated with the bearing housing 120 or to engage with the fastening member 130 provided as a separate component. In the case of engaging with the separate fastening member 130, the fastening part 124 is formed with a through-hole 124*a* such that the separate fastening member 130 can pass through the through-hole 124*a* to engage with the fastening part 124.

The fastening part 124 is provided with a protuberance 124*b* to allow the stator 140 and the bearing housing 120 to be accurately coupled to each other at a desired location. The stator 140 can be accurately coupled to a desired part of the bearing housing 120 by means of a positioning protrusion (not shown) formed on the stator 140 and the protuberance 124*b* into which the positioning protrusion is inserted. The protuberance 124*b* may be configured to be exposed from the rear wall of the tub 110 during insert injection molding of the bearing housing 120 into the tub 110. In this manner, since the protuberance 124*b* is exposed from the tub 110, the positioning protrusion can be easily inserted into the protuberance 124*b*.

The flange part 126 extends from the fastening member 124 in the radial direction of the bearing housing 120. The flange part 126 enlarges a coupling area between the tub 110 and the bearing housing 120, thereby reinforcing the coupling area between the tub 110 and the bearing housing 120 while effectively absorbing and damping the vibration of the motor 40 during operation of the washing machine.

The bearing housing 120 may be formed of metallic materials such as aluminum and the like. In this case, since the bearing housing does not suffer thermal deformation even at high temperatures, it can be applied to a drum type washing machine that performs a drying operation.

The tub 110 is described as being made of the plastic material or the synthetic resin in the first embodiment of the invention, but the present invention is not limited thereto. Alternatively, the tub 110 may be made of metallic materials, and in this case, the bearing housing 120 can be insert-injection molded into the tub 110 by die-casting or the like.

The fastening member 130 may be formed integrally with the bearing housing 120 or may be provided as a separate component to be fastened to the bearing housing 120. In the case where the fastening member 130 is provided as a separate component, the fastening member 130 is mounted to the bearing housing 120 through the through-hole 124*a* formed in the fastening part 124.

Since the bearing housing 120 is insert-injection molded into the tub 110 with the fastening member 130 provided to the bearing housing 120, the bearing housing 120 is surrounded by the rear wall of the tub 110 after the insert injection. At this time, one end of the fastening member 130 is exposed from the rear wall of the tub 110.

The fastening member 130 has a thread formed on an outer circumference thereof for easy coupling to other members. In this embodiment, a bolt is provided as the fastening member 130.

The stator 140 is positioned on the rear wall of the tub 110 through the fastening member 130. At this time, the stator 140 is accurately guided to a desired position on the rear wall of the tub 110 by the positioning protrusion and the protuberance 124*b* as described above.

Then, as the nut member 150 coupled to the fastening member 130 is tightened, the stator 140 is brought into close contact with the rear wall of the tub 110, and finally comes into surface contact with the rear wall of the tub 110, so that the stator 140 is rigidly positioned on the rear wall of the tub 110.

In this manner, since the bearing housing 120 is formed integrally with the tub 110 via insert injection molding into the tub 110, the bearing housing 120 can be prevented from shaking during operation of the washing machine, and thus, concentricity of the stator 140 closely contacting the rear wall of the tub 110 can also be maintained.

Figure 5:
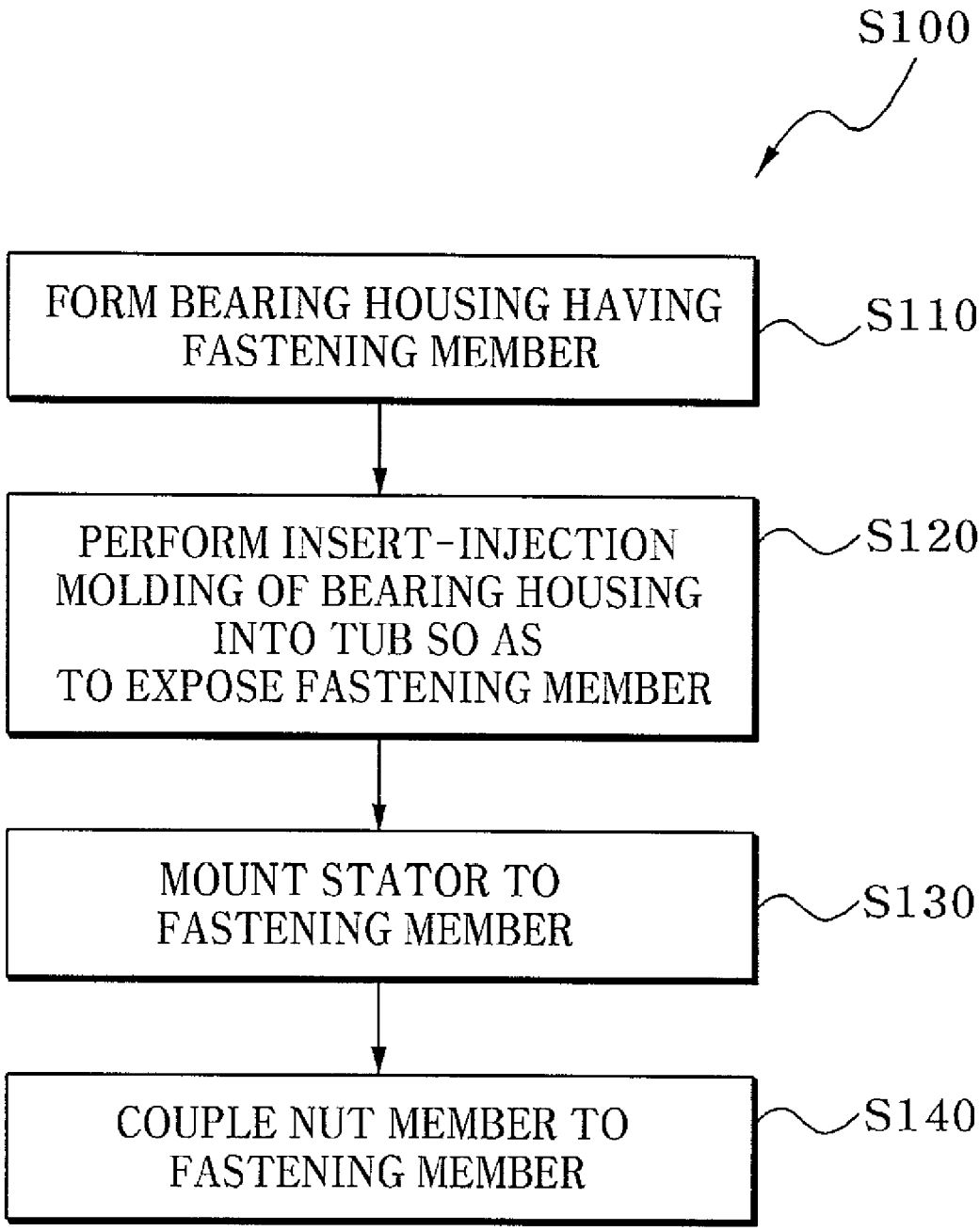
FIG. 5 is a flowchart of a method for manufacturing the washing machine according to the first embodiment of the present invention.

FIG. 5 is a flowchart of a method for manufacturing the washing machine according to the first embodiment of the present invention.

Next, referring to FIGS. 2 and 5, the method for manufacturing the washing machine according to the first embodiment of the invention will be described.

In manufacture of the washing machine according to the first embodiment (S100), a bearing housing 120 having a fastening member 130 is formed in Operation S110. As described above, the fastening member 130 may be formed integrally with the bearing housing 120 or may be provided as a separate component to be fastened to the bearing housing 120.

Then, the bearing housing 120 is insert-injection molded to a tub 110. At this time, in Operation S120, the insert injection molding may be performed such that the fastening member 130 of the bearing housing 120 is exposed from the rear wall of the tub 110.

After fastening a stator 140 to the fastening member 130 exposed from the rear wall of the tub 110 in Operation S130, a nut member 150 is coupled to the fastening member 130 which has a thread formed on an outer circumference of the fastening member 130, in Operation S140, so that the stator 140 comes into close contact with the rear wall of the tub 110 by tightening the nut member 150. As a result, the stator 140 can be rigidly positioned on the rear wall of the tub 110, thereby completing assembly of the stator 140 to the rear wall of the tub 110.

Figure 6:
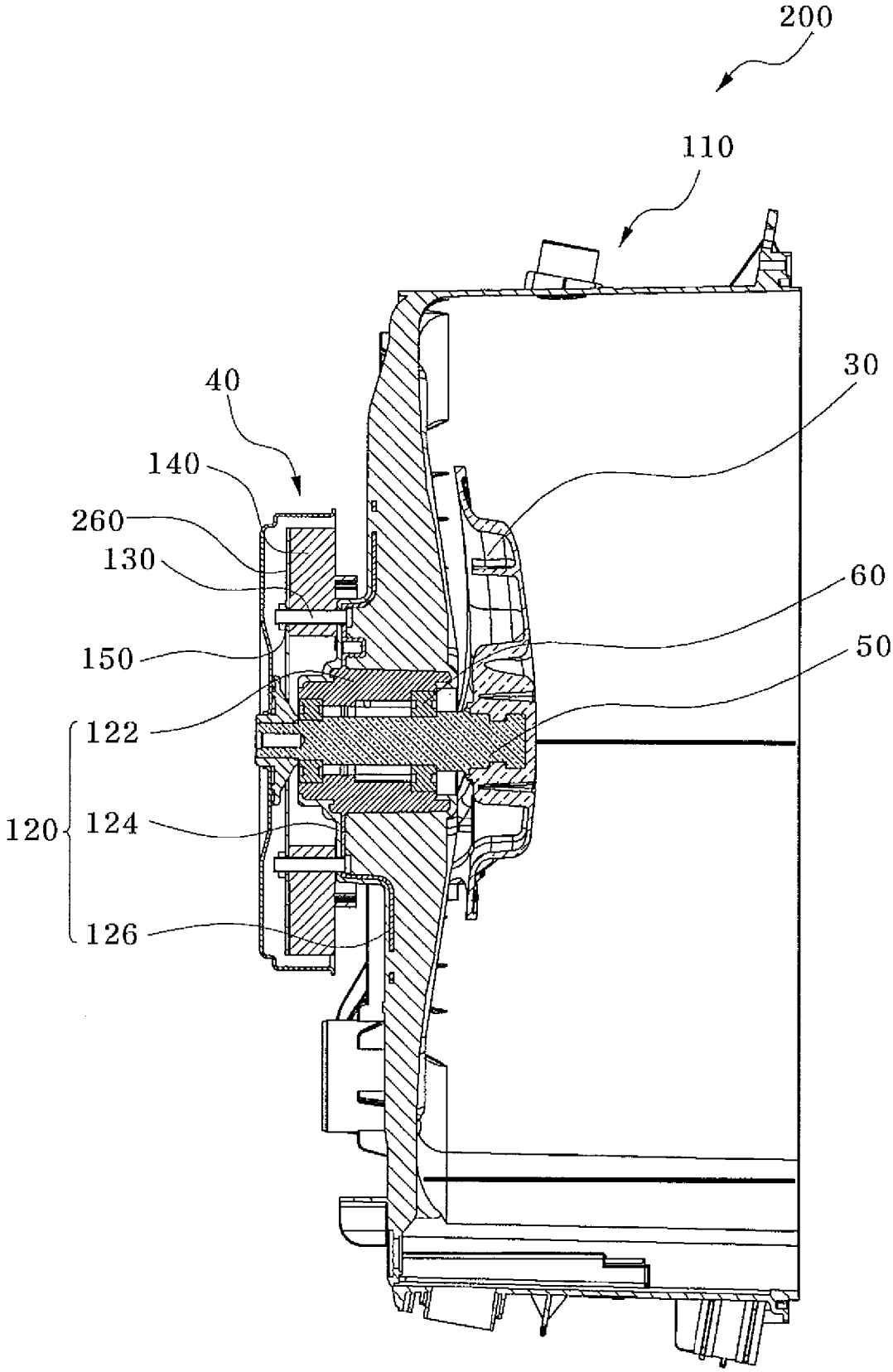
FIG. 6 is a section side elevation of a washing machine according to a second embodiment of the present invention.
Figure 7:
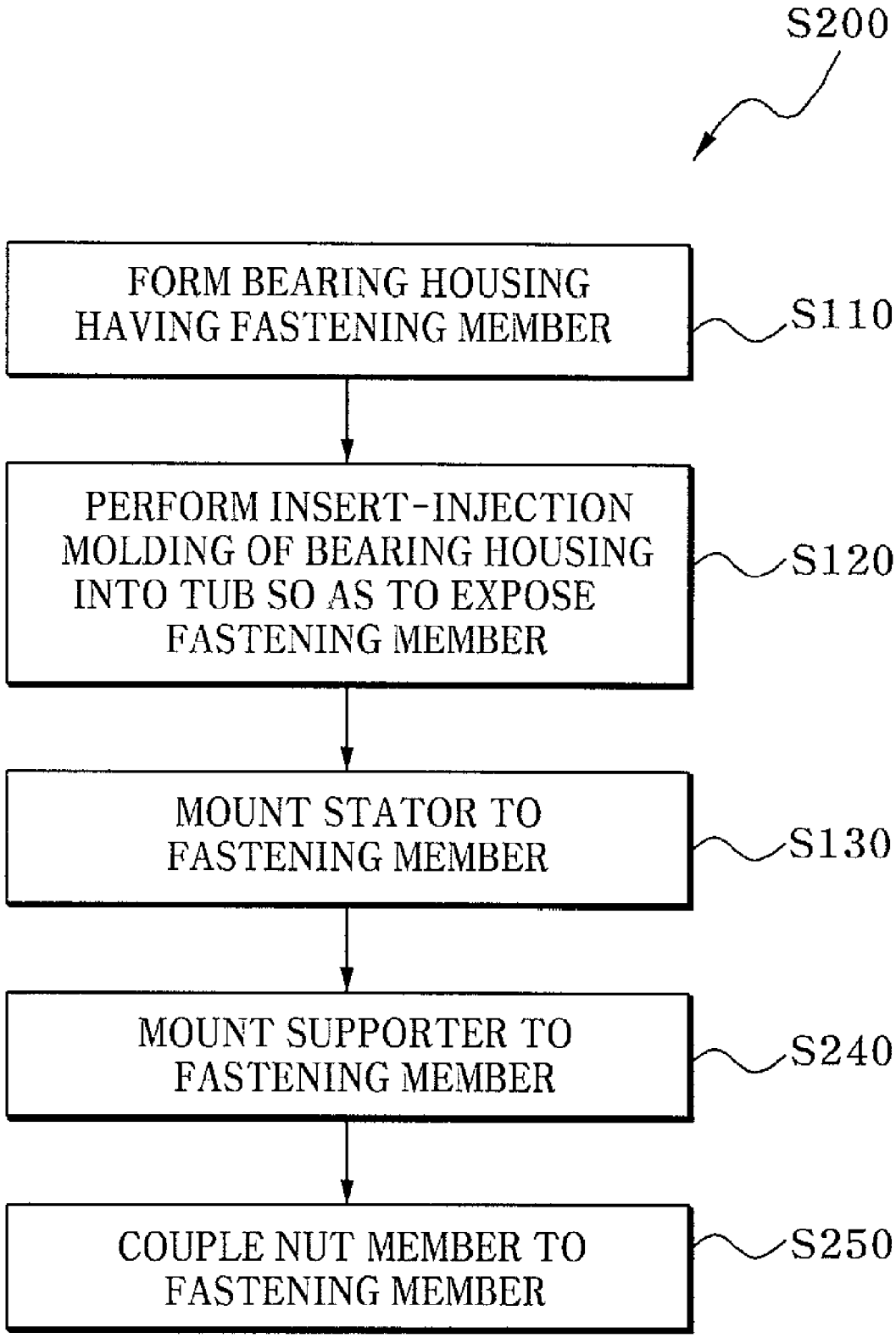
FIG. 7 is a flowchart of a method for manufacturing the washing machine according to the second embodiment of the present invention.

FIG. 6 is a section side elevation of a washing machine according to a second embodiment of the present invention, and FIG. 7 is a flowchart of a method for manufacturing the washing machine according to the second embodiment of the present invention.

Next, referring to FIGS. 6 and 7, the washing machine and method for manufacturing the same according to this embodiment will be described. Herein, the same reference numerals as those of the aforementioned embodiment will denote the same components having the same functions, and a repetitious description thereof will be omitted.

Referring to FIG. 6, the washing machine 200 according to the second embodiment further includes a supporter 260. The supporter 260 is configured to closely support the stator 140 such that the concentricity of the stator 140 can be maintained when fastening the stator 140 so as to closely contact the rear wall of the tub 110.

Supporting of the supporter 260 with respect to the stator 140 can be accomplished via point contacts at a plurality of points. Alternatively, it can be accomplished via a line contact or surface contact.

As such, the supporter 260 closely contacts the whole body of the stator 140, thereby preventing deviation of the concentricity due to concentration of a fastening force or supporting force on a particular portion of the stator 140.

With the stator 140 mounted to the fastening member 130 in Operation S130, the supporter 260 is mounted to the fastening member 130 to be located outside the stator 140 in Operation S240.

Then, when the nut member 150 is coupled to the fastening member 130 which has a thread formed on an outer circumference of the fastening member 130, in Operation S250, the nut member 150 is tightened to force the supporter 260 to compress the stator 140, which in turn is brought into close contact with the rear wall of the tub 110. As a result, the stator 140 can be rigidly positioned on the rear wall of the tub 110, thereby completing assembly of the stator 140 to the rear wall of the tub 110.

Figure 8:
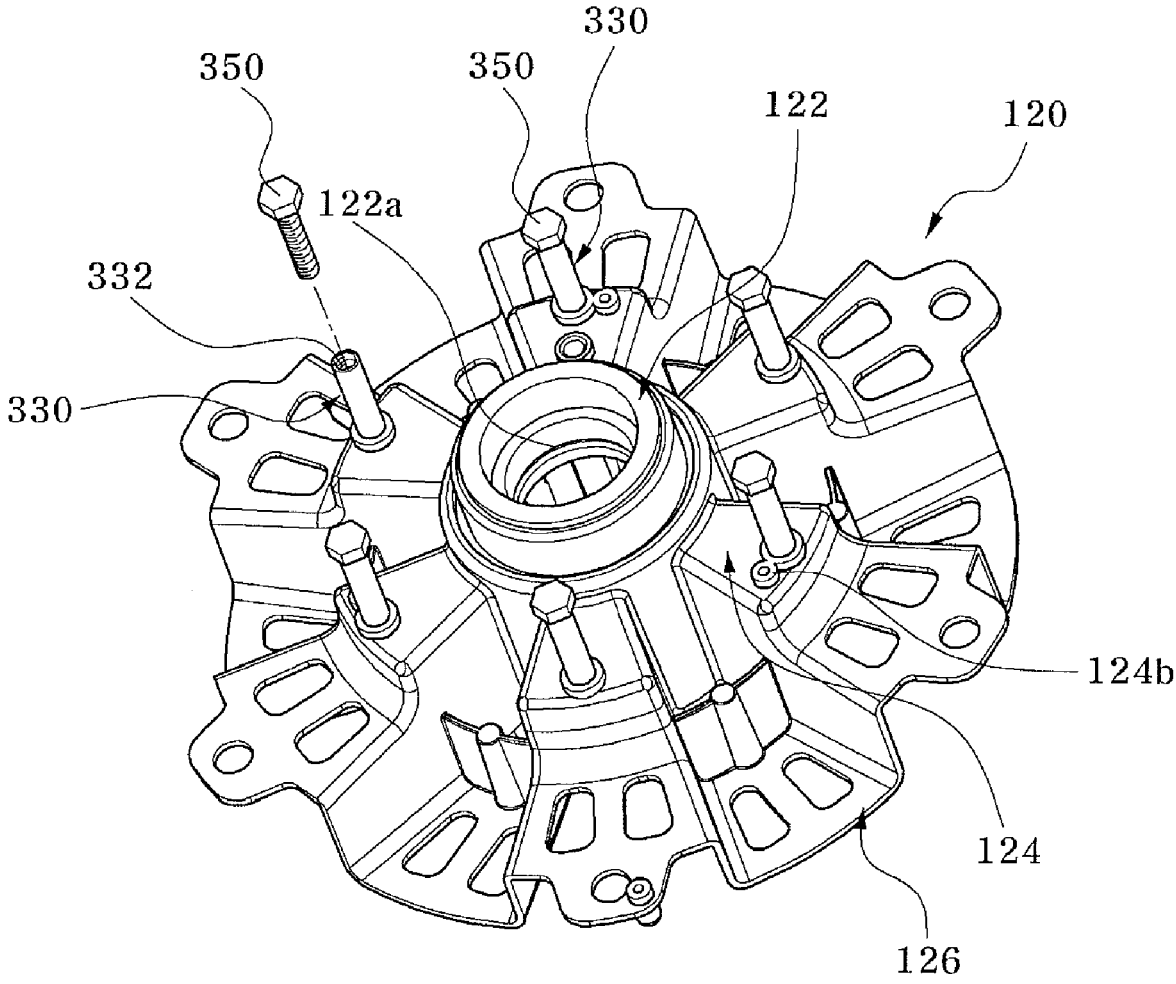
FIG. 8 is a perspective view of a bearing housing and a fastening member of a washing machine according to a third embodiment of the present invention.

FIG. 8 is a perspective view of a bearing housing and a fastening member of a washing machine according to a third embodiment of the present invention. Herein, the same reference numerals as those of the aforementioned embodiments will denote the same components having the same functions, and a repetitious description thereof will be omitted.

Unlike the fastening member 130 (see FIG. 4) of the first embodiment, a fastening member 330 of the washing machine according to the third embodiment includes a fastening hole 332 having a thread formed on an inner circumference of the fastening member 330. Accordingly, instead of the nut member 150 (see FIG. 2), the washing machine of this embodiment includes a bolt member 350 having a thread on an outer circumference of the bolt member 350 in order to assemble the stator 140 to the rear wall of the tub 110.

As apparent from the above description, in the washing machine according to the present invention, a bearing housing is insert-injected to a tub of the washing machine to eliminate a process of assembling the bearing housing to the tub, thereby simplifying an assembling process and reducing manufacturing costs.

Further, in the washing machine according to the present invention, a fastening member, the bearing housing, and the tub are integrally formed by insert-injection molding to eliminate an assembly clearance, which can be generated during assembly, so that the bearing housing can be prevented from shaking during operation of the washing machine, thereby maintaining concentricity of a stator.

Although the present invention has been described with reference to the embodiments and the accompanying drawings, it will be apparent to those skilled in the art that the embodiments are given by way of illustration, and that various modifications and equivalent embodiments can be made without departing from the spirit and scope of the present invention. Further, the description of the drum type washing machine as provided herein is only one example of the present invention, and the present invention can be applied to other devices. Accordingly, the scope and spirit of the present invention should be limited only by the following claims.

What is claimed is:

1. A washing machine comprising:

a tub;

a bearing housing having a fastening member, both the bearing housing and the fastening member formed by insert-injection molding into the tub so that one end of the fastening member protrudes from a rear wall of the tub;

a stator mounted to the one end of the fastening member, and a nut member coupled to the fastening member to force the stator to come into close contact with the rear wall of the tub, wherein the fastening member is provided as a separate component to be fastened to the bearing housing, and the fastening member includes a second end opposed to the one end, and the second end is embedded in the tub.

2. The washing machine according to claim 1, wherein the bearing housing comprises:

a bearing support having a stepped surface on an inner circumference of the bearing support to support a bearing;

a fastening part extending radially from the bearing support and provided with the fastening member; and a flange part extending radially from the fastening part.

3. A washing machine comprising:

a tub;

a bearing housing having a fastening member, both the bearing housing and the fastening member formed by insert-injection molding into the tub so that one end of the fastening member protrudes from a rear wall of the tub;

a stator mounted to the one end of the fastening member;

a supporter mounted to the fastening member to support the stator, a nut member coupled to the fastening member to force the stator to come into close contact with the rear wall of the tub, wherein the fastening member is provided as a separate component to be fastened to the bearing housing, and the fastening member includes a second end opposed to the one end, and the second end is embedded in the tub.

4. A method for manufacturing a washing machine, comprising:

forming a bearing housing having a fastening member;

insert-injection molding the bearing housing and the fastening member into a tub so that one end of the fastening member protrudes from a rear wall of the tub;

mounting a stator to the one end of the fastening member; and coupling a nut to the fastening member to force the stator to come into close contact with the rear wall of the tub, wherein the fastening member is provided as a separate component to be fastened to the bearing housing, and;

the fastening member includes a second end opposed to the one end, and the second end is embedded in the tub.

5. A method for manufacturing a washing machine, comprising:

forming a bearing housing having a fastening member;

insert-injection molding the bearing housing and the fastening member into a tub so that one end of the fastening member protrudes from a rear wall of the tub;

mounting a stator to the one end of the fastening member;

mounting a supporter to the fastening member to support the stator; and coupling a nut to the fastening member to force the stator to come into close contact with the rear wall of the tub, wherein the fastening member is provided as a separate component to be fastened to the bearing housing, and;

the fastening member includes a second end opposed to the one end, and the second end is embedded in the tub.

* * * * *